US006160343A

United States Patent [19]

Joung

[11] Patent Number: 6,160,343

[45] Date of Patent: Dec. 12, 2000

[54] APPARATUS FOR COMPENSATING CONVERGENCE IN A COLOR CATHODE RAY TUBE

[75] Inventor: JangJin Joung, Suwon-shi, Rep. of Korea

[73] Assignee: SamSung Display Devices Co., Ltd., Kyonggi-Do, Rep. of Korea

[21] Appl. No.: 09/152,304

[22] Filed: Sep. 14, 1998

[30] Foreign Application Priority Data

May 6, 1998 [KR] Rep. of Korea ..... 98-16164

[51] Int. Cl.[7] ..... H01J 29/70

[52] U.S. Cl. ..... 313/440; 313/430; 313/431

[58] Field of Search ..... 313/412, 421, 313/426, 428, 430, 431, 440; 335/212

[56] References Cited

U.S. PATENT DOCUMENTS 4,670,726 6/1987 Ogata et al. ..... 313/212

*Primary Examiner*—Vip Patel

*Attorney, Agent, or Firm*—Baker & McKenzie

[57] ABSTRACT

This invention relates to an apparatus for compensating convergence in a color cathode ray tube, more particularly to an apparatus for minimizing the convergence drift variance of R and B electron beams on a screen so as to improve convergence characteristics and a picture quality on the screen. The apparatus for compensating convergence drift comprising: a convergence purity magnet for converging the electron beams emitted from the electron gun on the specific point of the screen of the color cathode ray tube; and a supplementary magnet ring 52 with at least four-magnetic pole contacting the neck N between a second grid electrode 24 and the deflection yoke 60. Particularly, the supplementary magnet ring is mounted on a holder 48 of the convergence purity magnet 40 and has a pole arrangement to move the convergence of the R and B beams in the direction opposite to the electron gun from the screen.

8 Claims, 7 Drawing Sheets

APPARATUS FOR COMPENSATING CONVERGENCE IN A COLOR CATHODE RAY TUBE

BACKGROUND OF THE INVENTION

1. Field of the Invention

This invention relates to an apparatus for compensating convergence in a color cathode ray tube, more particularly to an apparatus for compensating the convergence drift of red and blue electron beams on a screen to improve convergence characteristics.

2. Description of the Prior Art

A color cathode ray tube is a device for producing an image on a screen with a light emission of a fluorescent material by landing an electron emitted from an electron gun and accelerated by a high voltage.

FIG. 6 shows a general structure of such a color cathode ray tube.

Electron beams are emitted from an In-Line type electron gun 2 mounted on the neck N of the color cathode ray tube. A convergence purity magnet (CPM) 4 is provided to converge the electron beams on the specific point on the screen and a deflection yoke is provided to scan the electron beams so that the desired picture is realized by landing the electron beams through a shadow mask on the corresponding red, green and blue fluorescent materials of the screen.

The CPM 4 comprises a magnetic ring assembly mounted on the neck having each pair of two, four and six-magnetic pole rings with a holder and a spacer so that the purity control by the two-magnetic pole rings and the convergence control by the four and six-magnetic pole rings are obtained.

The controls are performed as follows:

At first, the red(R), green(G) and blue(B) electron beams are deflected by a pair of two-pole rings so as to move their landing points in the same direction, whereby the landing position of the G beam is centered; second, the R and B beams are deflected by a pair of four-pole rings so that their landing points are moved in the opposite directions respectively, whereby the R and B beams are converged with the same distance; finally, the converged R and B beams are centered by a pair of six-pole rings so that the R, G and B electron beams are converged on the specific point on the screen.

In the case, an outer convergence variance(OCV) i.e., the distance between the R and B electron beams is controlled by the pair of four-pole rings and an center convergence variance(CCV) i.e., the distance between the G electron beam and a center position of the OCV is controlled by the pair of six-pole rings.

However, such a color cathode ray tube is on and some time passes, the thermal deformation is occurred in the electrodes of electron gun, which causes a convergence drift. That is, a first grid electrode(Gl electrode) 2*b* and a second grid electrode (G2 electrode) 2*c* adjacent to a heater of a cathode 2*a* are thermally expanded, thereby causing a thermal drift of convergence in the color cathode ray tube. The heater of the cathode 2*a* is generally heated at 780° C., and the temperature of the first grid electrode 2*b* is raised up to 400° C. and the second grid electrode 2*c* is heated to the temperature in the range of 150° C. to 200° C., whereby the initial convergence C is drifted to the positive direction (in the direction toward the electron gun from the screen), i.e., C1 as shown in FIG. 7 by the thermal expansion of the first grid electrode 2*b*, and the convergence is again drifted to the negative direction (in the direction opposite to the electron gun from the screen), i.e., C2 as shown in FIG. 7 by the thermal expansion of the second grid electrode 2*c*.

Accordingly, the convergence is drifted to about +0.05 mm (C1) for the initial 10–15 minutes of the operation of the color cathode ray tube under the thermal effect of the first grid electrode and then to −0.15 mm (C2) under the thermal effect of the second grid electrode after 120–150 minutes.

Also, in the conventional color cathode ray tube, a positive charge component is occurred in the end portion of the neck by the concentration of an impurity in the color cathode ray tube, which causes a charge drift(CG), so that the convergence is more drifted to −0.22 mm.

To compensate the convergence drift, Korean Utility Model Publication No. 96 -6527 discloses "Convergence magnet assembly with a dummy magnetic poles for cathode ray tube" in which a spacer formed with the magnetic poles PN and Ps of resin magnetic material is provided in the CPM to adjust the outer convergence variance and the center convergence variance.

However, such convergence magnet assembly cannot reduce the total convergence drift (C1+C2+CG).

SUMMARY OF THE INVENTION

Accordingly, the present invention is directed to a convergence purity magnet that substantially obviates one or more of the problems due to limitations and disadvantages of the related art.

It is therefore the object of this invention to provide an apparatus for compensating a convergence drift by controlling the convergence drift so that the convergence drift is moved in the negative direction i.e., the opposite direction to an electron gun from a screen during the initial operation of a color cathode ray tube and then is moved in the positive direction i.e., the direction toward the electron gun from the screen when the neck reaches the certain temperature, thereby reducing the total convergence drift to improve the convergence characteristics of the R and B electron beams on the screen.

The convergence compensating apparatus according to the invention comprises a convergence purity magnet for converging the electron beams emitted from the electron gun on the specific point of the screen of the color cathode ray tube, wherein a supplementary magnet ring with at least four-magnetic pole is provided between a second grid electrode and the deflection yoke contacting the neck. The supplementary magnetic ring is disposed around the neck, preferably, with a clearance of about 0–2.0 mm there between.

The supplementary magnet ring is preferably made of ferrite of which the magnetic flux density is changed at the rate of −0.2%/° C. or alnico of which the magnetic flux density is changed at the rate of −0.02%/° C. when the neck is heated to a certain temperature.

The supplementary magnet ring is provided to the holder of the convergence purity magnet adjacent to the deflection yoke and has the magnetic pole to move the convergence of the R and B beams in the direction opposite to the electron gun from the screen i.e., in the negative direction, so that the initial positive convergence drift caused by the thermal expansion of the first grid electrode is compensated, and the negative convergence drift by the thermal expansion of the second grid electrode and the charge drift is compensated when the neck is heated to the certain temperature, the magnetic flux density of the supplementary magnet is thermally changed at the rate of −0.2%/° C.

BRIEF DESCRIPTION OF THE DRAWINGS

The invention will now be described by way of example with reference to the accompanying drawings of which.

DETAILED DESCRIPTION OF THE INVENTION

Figure 1:
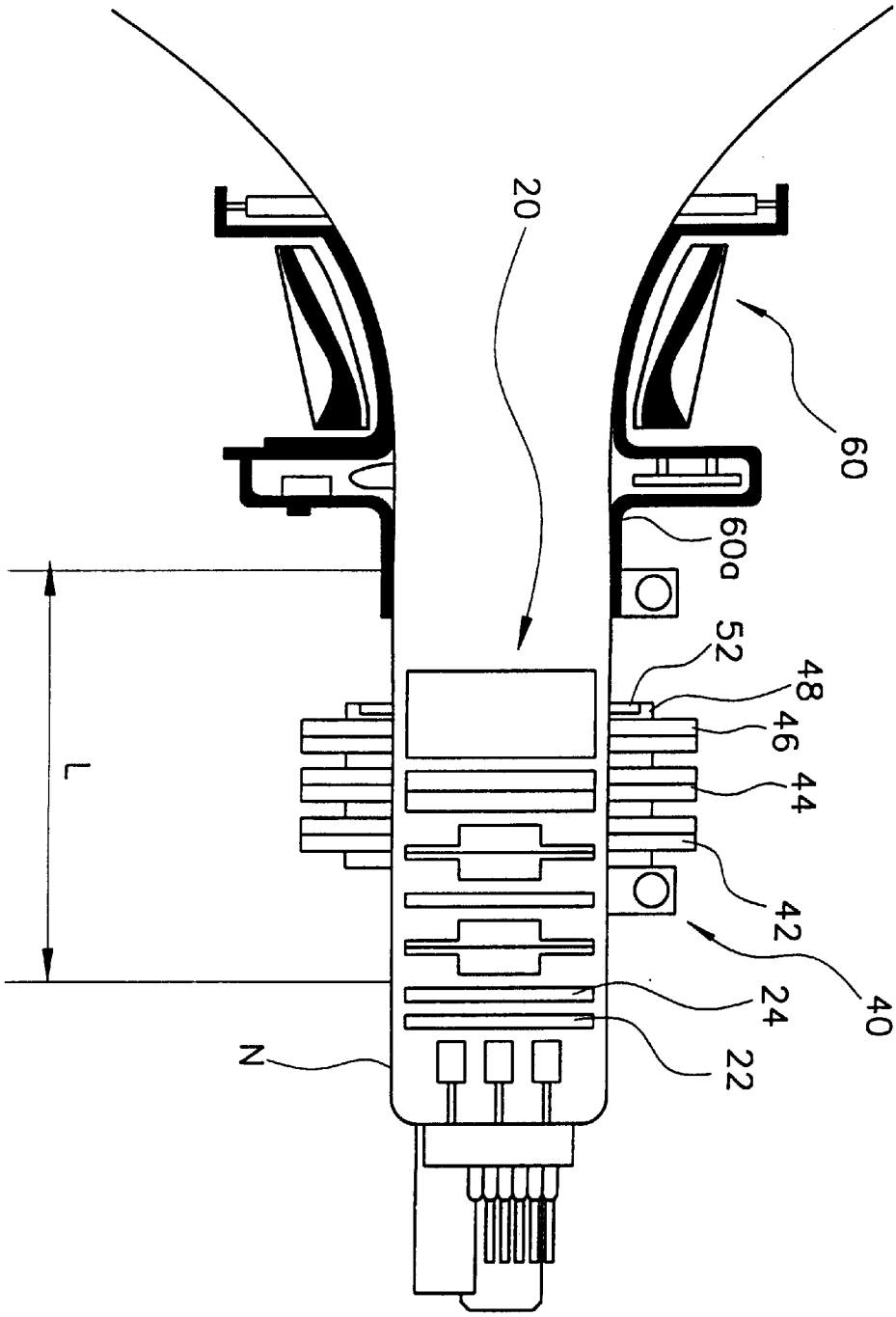
FIG. 1 is a sectional view of a convergence apparatus according to the present invention.
Figure 2:
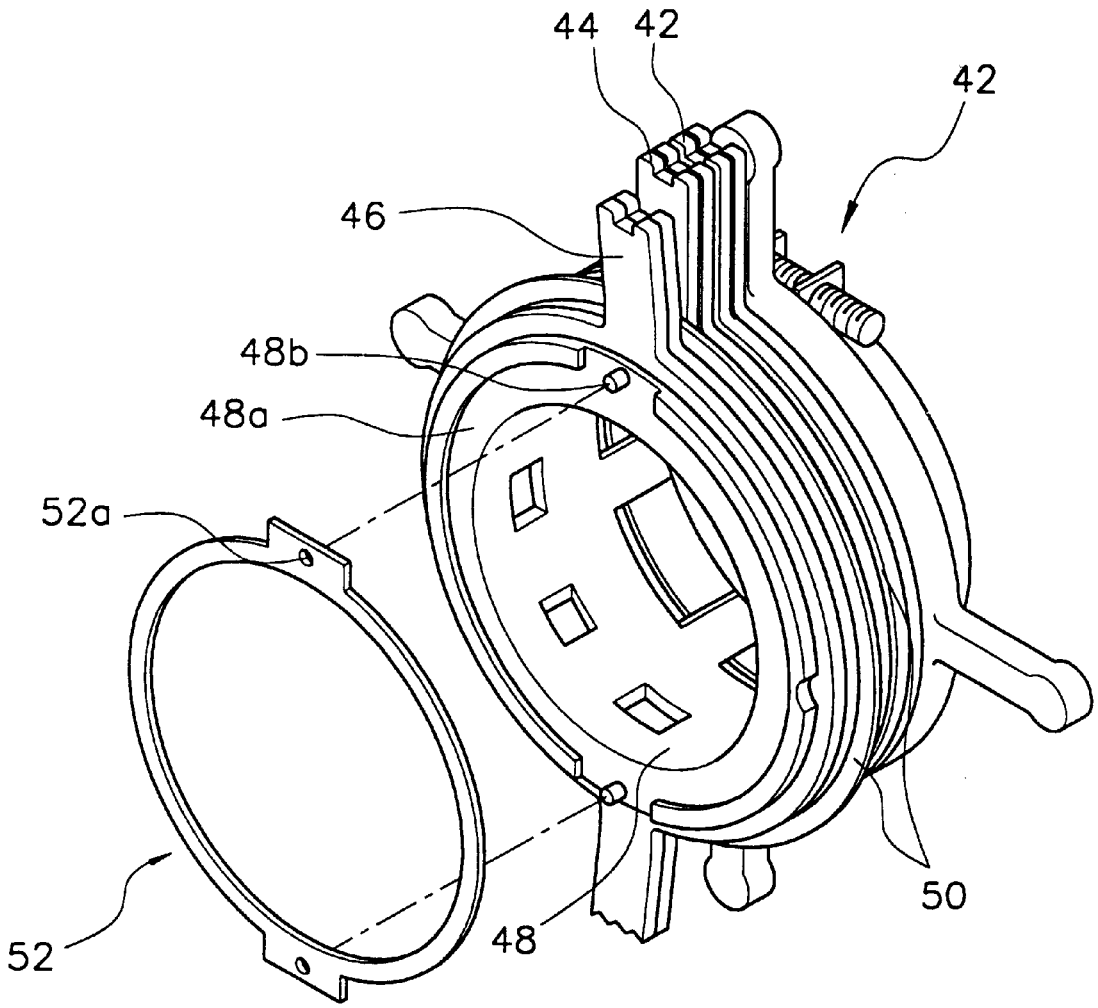
FIG. 2 is a perspective view of the convergence apparatus according to the present invention.

FIG. 1 shows the mounting of a convergence compensating apparatus according to the present invention and FIG. 2 shows the structure of the convergence compensating apparatus according to the present invention.

The convergence compensating apparatus according to the present invention comprises a convergence purity magnet(CPM) 40 for converging electron beams emitted from the electron gun 20 mounted on a neck N on the specific point on a screen, and a supplementary magnetic ring 52 provided between a second grid electrode and the deflection yoke contacting the neck. The supplementary magnetic ring 52 is disposed around the neck, preferably, with a clearance of about 0–2.0 mm there between. A deflection yoke 60 is provided to scan the electron beams onto a screen.

The CPM 40 comprises three magnetic rings 42, 44, 46 with each pair of two, four and six-magnetic pole, which are mounted on the corresponding holder 48 provided on the neck N, respectively and each being spaced by a spacer 50.

The supplementary magnetic ring 52 is mounted on the holder 48 having a groove 48*a* and a protrusion 48*b* which is inserted into the opening 52*a* of the supplementary magnetic ring 52. The inner diameter of the opening 52*a* is approximately equal to that of the holder 48 contacting the surface of the neck N.

The supplementary magnetic ring 52 may be provided in any position from a second grid electrode 24 of the electron gun 20 to the holder 60*a* of the deflection yoke 60 contacting the neck N as far as the supplementary magnetic ring 52 can be disposed around the neck.

Figure 3:
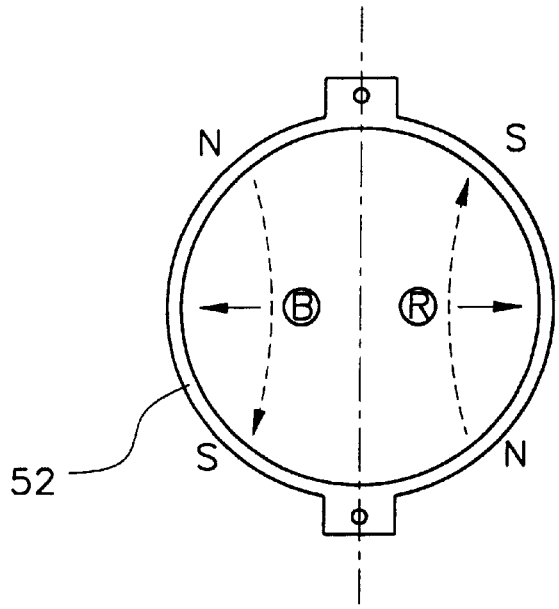
FIG. 3 is a front view of the convergence apparatus according to the present invention.
Figure 4:
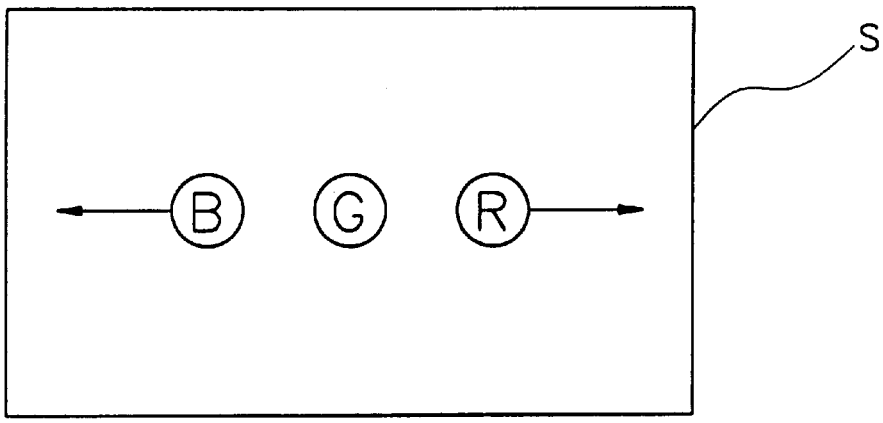
FIG. 4 shows an operational effects of the convergence apparatus according to the present invention.
Figure 7:
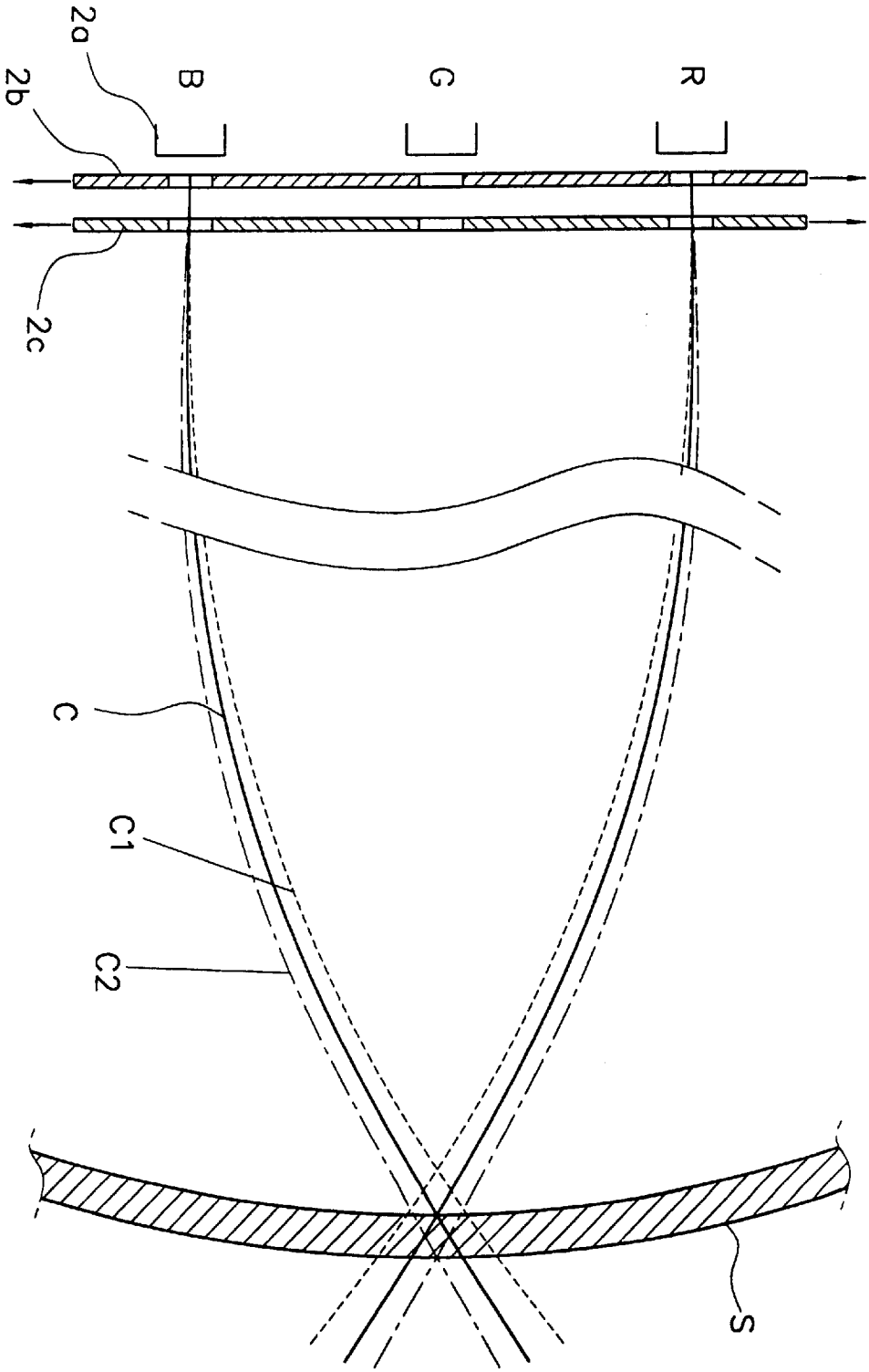
FIG. 7 shows a convergence drift in the conventional color cathode ray tube.
Figure 8:
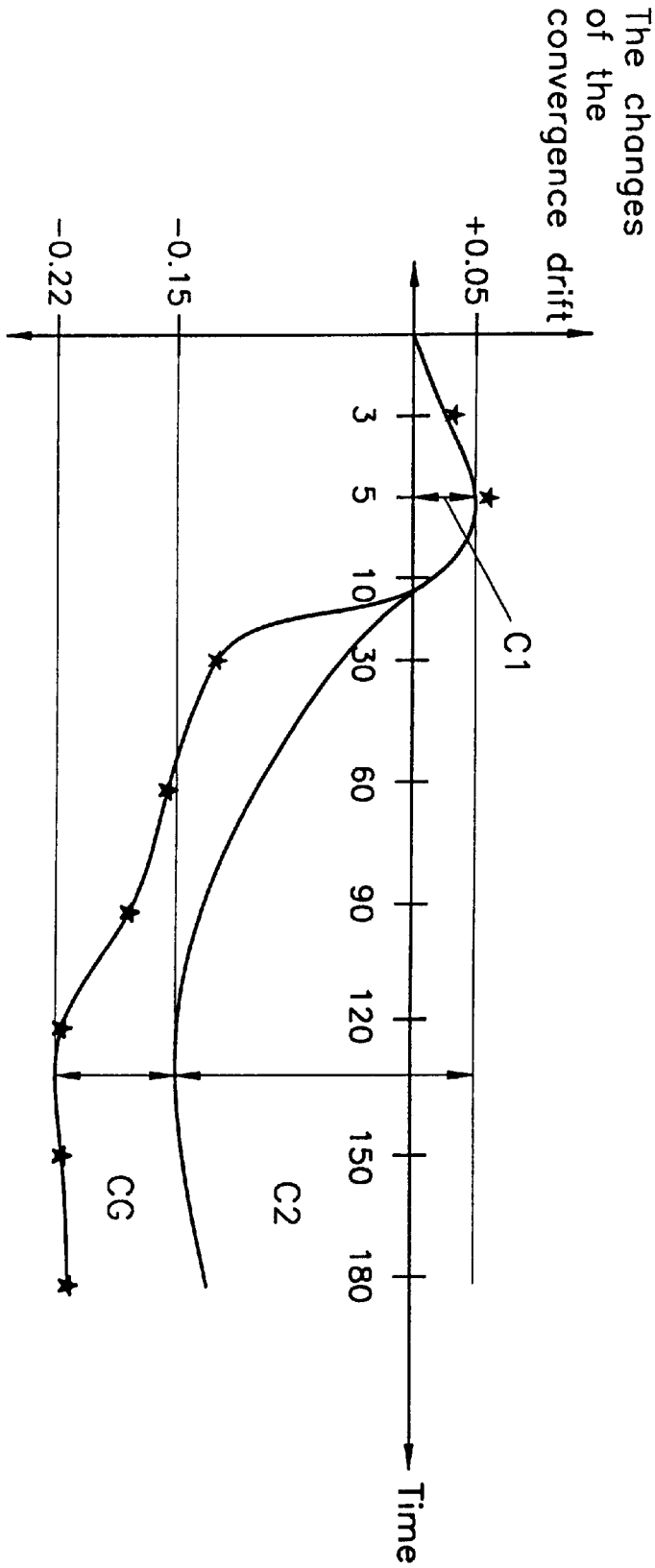
FIG. 8 shows the changes of the convergence drift of the conventional color cathode ray tube.

The supplementary magnetic ring 52 has at least four-magnetic pole as shown in FIG. 3 for moving the R and B beams away from each other or in the opposite direction to the electron gun (in the negative direction in FIG. 7), so that the convergence of the R and B electron beams is moved away from the screen i.e., in the negative direction.

Accordingly, the positive convergence drift caused by the expansion of the first grid electrode 22 of the electron gun 20 at the initial operation thereof is compensated in the negative direction.

Furthermore, the supplementary magnetic ring 52 is made of the material such as ferrite, of which the magnetic flux density is thermally changed at the rate of −0.2%/° C. or such as alnico, of which the magnetic flux density is thermally changed at the rate of −0.02%/° C. Therefore, the convergence drift caused by the expansion of the second grid electrode 24 and the charge drift in the negative direction are compensated in the positive direction.

In this connection, to reflect the R and B beams at the same time, the supplementary magnetic ring 52 should have at least four-pole. In case of four-pole ring, the R and B beams are moved in the same direction as each other at the same time. And in case of six-pole ring, the R and B beams are moved in the direction opposite each other at the same time.

The variance of Gauss of the supplementary magnetic ring 52 by the change of the temperature is tested as in the Table 1, in which the supplementary magnetic ring 52 made of ferrite of 9.0 Gauss is used and shows the variance of the gauss of the magnetic ring by increasing of the temperature.

TABLE 1

| | sample | | | | | max. |
|---|---|---|---|---|---|---|
| temp. | 1 | 2 | 3 | 4 | 5 | value |
| 100 | 8 | 7.7 | 8.1 | 8 | 7.9 | 8.1 |
| 90 | 8.3 | 8.2 | 8.3 | 8.2 | 8.1 | 8.3 |
| 85 | 8.4 | 8.4 | 8.3 | 8.4 | 8.3 | 8.4 |
| 80 | 8.5 | 8.4 | 8.5 | 8.4 | 8.5 | 8.5 |
| 75 | 8.5 | 8.5 | 8.5 | 8.5 | 8.5 | 8.5 |
| 70 | 8.6 | 8.6 | 8.6 | 8.6 | 8.6 | 8.6 |
| 65 | 8.7 | 8.7 | 8.6 | 8.7 | 8.6 | 8.7 |
| 60 | 8.7 | 8.7 | 8.7 | 8.7 | 8.7 | 8.7 |
| 55 | 8.8 | 8.8 | 8.7 | 8.7 | 8.8 | 8.8 |
| 50 | 8.8 | 8.8 | 8.8 | 8.8 | 8.8 | 8.8 |
| 45 | 8.9 | 8.9 | 8.8 | 8.9 | 8.8 | 8.9 |
| 40 | 8.9 | 8.9 | 8.9 | 8.9 | 8.9 | 8.9 |
| 39 | 9 | 8.9 | 8.9 | 9 | 8.9 | 9 |
| 37 | 9 | 9 | 9 | 9 | 9 | 9 |

The convergence drift compensation of the supplementary magnetic ring 52 according to the present invention is performed as follows.

Figure 5:
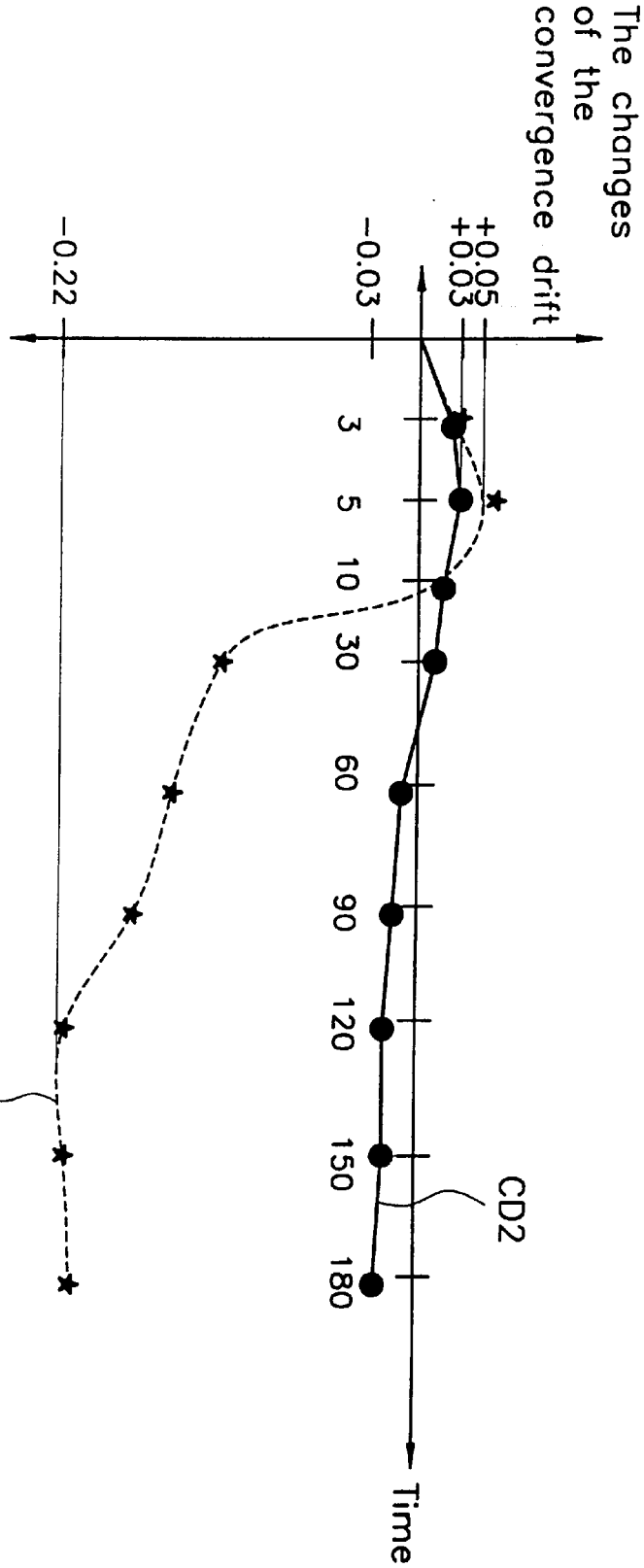
FIG. 5 shows the changes of the convergence drift of the color cathode ray tube with the apparatus according to the present invention is adapted.
Figure 6:
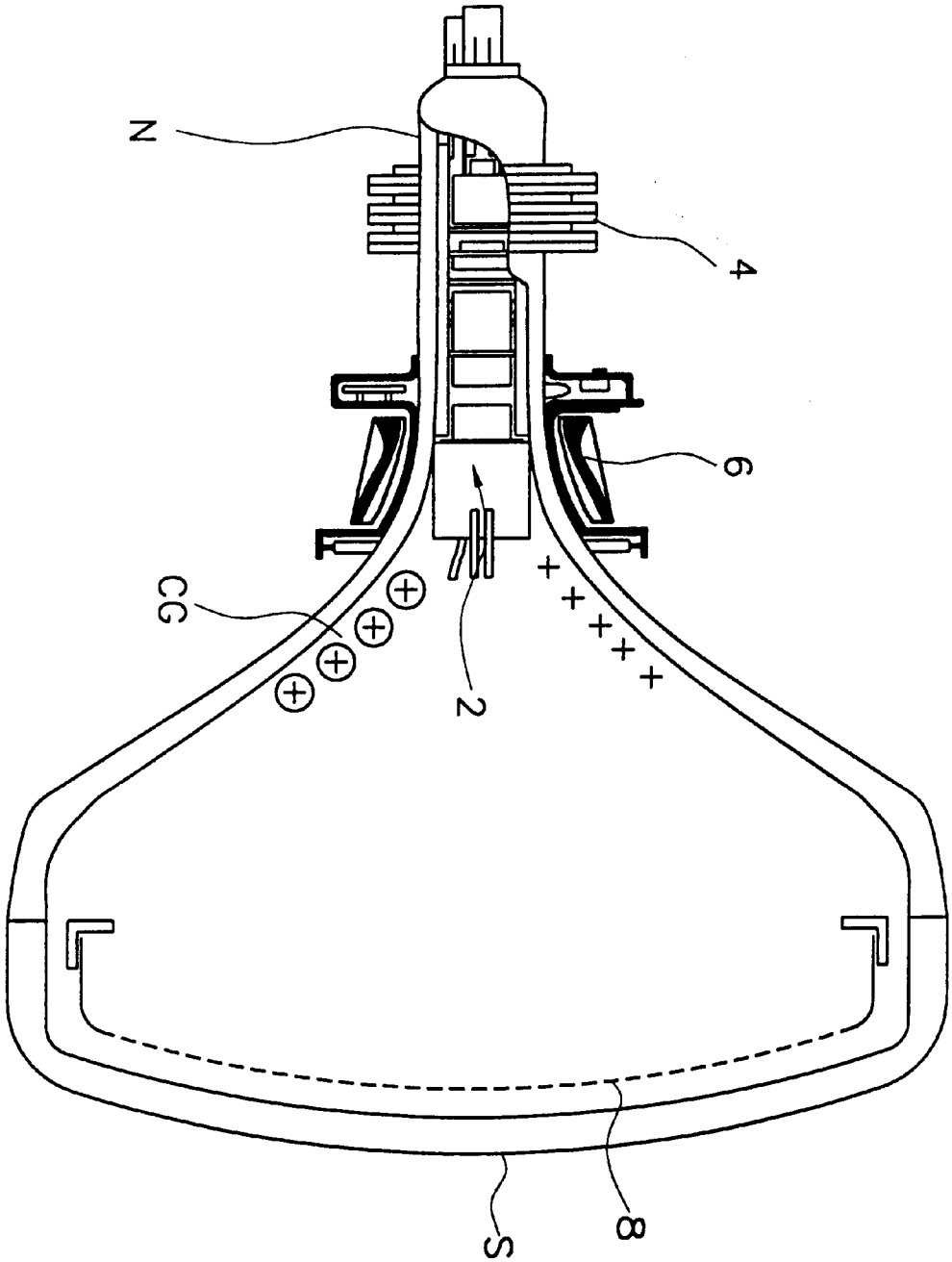
FIG. 6 is a sectional view of the conventional color cathode ray tube.

Referring to FIG. 5, the convergence drift CD2 with the supplementary magnetic ring 52 according to the present invention is greatly decreased as compared with the prior convergence drift CD1.

More specifically, the supplementary magnetic ring 52 with 9.0 Gauss compensates the convergence drift in the positive direction caused by thermal expansion of the first grid electrode 22 to maximum +0.03 mm which is decreased as compared with the +0.05 mm of the prior convergence drift.

At this time the compensation with the supplementary magnetic ring 52 according to the present invention is performed for 10–15 minutes until the temperature of the neck N reaches 37–40° C. and then, the supplementary magnetic ring 52 is thermally changed at the rate of −0.2%/° C. as shown in table 1, whereby the convergence drift in the negative direction caused by the second grid electrode 24 of the electron gun 20 and the charge drift are compensated in the positive direction.

Accordingly, the compensation with the supplementary magnetic ring according to the present invention is maximized to −0.03 mm at the 120–150 minutes after initiating of the operation of the color cathode ray tube, which results in the decrease of the variance of the convergence drift to 0.06 mm.

When using the supplementary magnetic ring 52 made of alnico, it is thermally changed at the rate of −0.02%/° C., whereby the convergence drift in the negative direction caused by the second grid electrode 24 of the electron gun 20 and the charge drift may be compensated in the positive direction.

As described in the above, the prior problems are overcome by the convergence compensation apparatus according to the present invention.

That is, the supplementary magnetic ring according to the present invention can compensates the convergence drift caused by the expansion of the first grid electrode of the electron gun during the initial operation of a color cathode ray tube, and when the neck reaches to the certain temperature, the magnetic flux density of the supplementary magnetic ring is changed, thereby compensating the convergence drift caused by the second grid electrode and the charge drift.

Therefore, the outer convergence variance can be kept close to the initial predetermined value, which minimizing the variance of the convergence drift to improve the convergence characteristics and the quality of the produced picture on the screen.

What is claimed is:

1. An apparatus for compensating convergence drift in a color cathode ray tube having an electron gun, a neck in which the electron gun is disposed, and a deflection yoke disposed around the neck, said apparatus comprising:

a convergence purity magnet for converging R, G and B electron beams emitted from the electron gun; and a supplementary magnet ring with at least four-magnetic pole, said supplementary magnet ring being disposed around the neck.

2. The apparatus according to claim 1 wherein said supplementary magnet ring is disposed around the neck with a gap of about 0.1–2.0 mm there between.

3. The apparatus according to claim 1 wherein said supplementary magnet ring is disposed to directly contact around the neck.

4. The apparatus according to claim 1 wherein said supplementary magnet ring is provided between a deflection yoke and a second grid electrode of the electron gun.

5. The apparatus according to claim 1 wherein said supplementary magnet ring is mounted on a holder of the convergence purity magnet.

6. The apparatus according to any one of the claims 1 to 5 wherein said supplementary magnet ring has a pole arrangement to move the convergence of the R and B beams in the direction opposite to the electron gun from the screen.

7. The apparatus according to any one of the claims 1 to 5 wherein said supplementary magnet ring is made of the material of which the magnetic flux density is thermally changed at the rate of −0.2%/° C. at the temperature of about 37–40° C.

8. The apparatus according to any one of the claims 1 to 5 wherein said supplementary magnet ring is made of the material of which the magnetic flux density is thermally changed at the rate of −0.02%/° C. at the temperature of about 37–40° C.

* * * * *